US012606999B2

(12) United States Patent
Huo

(10) Patent No.: US 12,606,999 B2
(45) Date of Patent: Apr. 21, 2026

(54) DRAIN AUGER

(71) Applicant: Nanjing Chervon Industry Co., Ltd., Nanjing (CN)

(72) Inventor: Tongle Huo, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 102 days.

(21) Appl. No.: 18/769,685

(22) Filed: Jul. 11, 2024

(65) Prior Publication Data

US 2025/0075482 A1 Mar. 6, 2025

Related U.S. Application Data

(63) Continuation of application No. PCT/CN2024/094100, filed on May 20, 2024.

(30) Foreign Application Priority Data

Aug. 30, 2023 (CN) ..... 202311111738.0
Aug. 30, 2023 (CN) ..... 202322353678.5

(51) Int. Cl.

| | |
|---|---|
| ***E03C 1/302*** | (2006.01) |
| ***B65H 75/40*** | (2006.01) |
| ***B65H 75/44*** | (2006.01) |

(52) U.S. Cl.

CPC ..... *E03C 1/302* (2013.01); *B65H 75/406* (2013.01); *B65H 75/4402* (2013.01); *B65H 75/4423* (2013.01); *B65H 75/4471* (2013.01)

(58) Field of Classification Search

CPC ... E03C 1/302; B65H 75/406; B65H 75/4402; B65H 75/4423; B65H 75/4471; B65H 75/362

See application file for complete search history.

(56) References Cited

U.S. PATENT DOCUMENTS

2020/0238345 A1* 7/2020 Mavros ..... E03F 9/005
2023/0149985 A1* 5/2023 Williams ..... B08B 9/0436 15/104.095

* cited by examiner

*Primary Examiner* — Christine J Skubinna
(74) *Attorney, Agent, or Firm* — Greenberg Traurig, LLP

(57) ABSTRACT

A drain auger includes a drum, a motor, and a cable. The drum forms an accommodation space. The motor drives the drum to rotate. The cable is at least partially stored in the accommodation space. The total length of the extended cable has a cable length L, the drum has an inner bottom surface forming the accommodation space, the diameter of the inner bottom surface is the first diameter D, and, when the cable length L and the first diameter D are both measured in centimeters, the ratio $L/D^2$ of the cable length L to the square of the first diameter D is greater than or equal to 3.5.

20 Claims, 9 Drawing Sheets

DRAIN AUGER

This application is a continuation of International Application Number PCT/CN2024/094100, filed on May 20, 2024, through which this application also claims the benefit under 35 U.S.C. § 119(a) of Chinese Patent Application No. CN 202311111738.0, filed on Aug. 30, 2023, and Chinese Patent Application No. CN 202322353678.5, filed on Aug. 30, 2023, which applications are incorporated herein by reference in their entireties.

TECHNICAL FIELD

The present application relates to a power tool and, in particular, to a drain auger.

BACKGROUND

A drain auger in the related art is a power tool for unclogging the pipe and mainly unclogs and cleans the pipe by continuously outputting a cable into the pipe.

The drain auger includes a drum for accommodating the cable, and the drum has a space for accommodating the cable. The space capacity of the drum of the existing drain auger is much greater than the volume of the cable, not only causing a waste of space but also increasing the volume of the drum and affecting the dynamic balance of the drain auger.

This part provides background information related to the present application, and the background information is not necessarily the existing art.

SUMMARY

The present application adopts the technical solutions below. A drain auger includes a drum forming an accommodation space; a motor that drives the drum to rotate; and a cable at least partially stored in the accommodation space. The total length of the extended cable is defined as the cable length L, the drum has an inner bottom surface forming the accommodation space, the diameter of the inner bottom surface is the first diameter D, and when the cable length L and the first diameter D are both measured in centimeters, the ratio $L/D^2$ of the cable length L to the square of the first diameter D is greater than or equal to 3.5.

In some examples, the first diameter D is less than or equal to 14.5 cm.

In some examples, the maximum outer diameter of the drum is the second diameter D1, where the second diameter D1 is less than or equal to 17 cm.

In some examples, the cable placed in the accommodation space is in a coiled state, the maximum coiling height of the coiled cable is H, and when the cable length L is 762 cm, the maximum coiling height H is less than or equal to 7.5 cm.

In some examples, the drain auger further includes a handle and a feeding mechanism, where the handle is connected to the rear of the drum and is used for a user to hold, the feeding mechanism is connected to the front of the drum and is used for feeding or retracting the cable, and the distance between the rear end surface of the handle and the front end surface of the feeding mechanism is the overall length L0 of the drain auger, where the overall length L0 is less than or equal to 37 cm.

In some examples, the drain auger further includes an operating member, where the operating member is connected to the feeding mechanism and is used for changing a state in which the feeding mechanism clamps the cable, and the distance between the front end surface of the feeding mechanism and the rear end surface of the operating member is the first length L1, where the first length L1 is less than or equal to 12 cm.

In some examples, the distance between the front end surface of the feeding mechanism and the rear end surface of the drum is the second length L2, where the second length L2 is less than or equal to 23 cm.

In some examples, the operating member includes a first end and a second end opposite to each other, the first end is rotatably connected to the feeding mechanism, the second end is a pressing end, and an elastic member is disposed between the middle part of the operating member and the feeding mechanism; the drain auger further includes a limiting elastic piece, where an end of the limiting elastic piece is fixedly connected to the first end, and the other end of the limiting elastic piece is provided with a clamping portion capable of clamping the cable.

In some examples, a channel for the cable to pass through is formed in the feeding mechanism, and the radial dimension of the channel is changeable by operating the operating member; and the cable includes a body portion and a limiting protrusion, the radial dimension of the limiting protrusion is greater than the radial dimension of the body portion, and when the operating member is in an initial state, the radial dimension of the channel is less than the radial dimension of the limiting protrusion.

In some examples, the effective volume of the accommodation space of the drum is defined as V1, $V1=\pi\times(D/2)^2\times H$, H denotes the maximum coiling height of the cable coiled in the accommodation space, and when the cable length L is measured in centimeters and the effective volume V1 is measured in cubic centimeters, the ratio of the cable length L to the effective volume V1 is greater than or equal to 0.75.

In some examples, the total volume of the accommodation space of the drum is V2, and the ratio of the effective volume V1 to the total volume V2 is greater than or equal to 80% and less than or equal to 100%.

In some examples, the accommodation space includes the inner bottom surface and an inner top surface, the distance between the inner bottom surface and the inner top surface is the second distance B, the drum further includes a raised structure protruding from the inner bottom surface and extending toward the inner top surface, the raised structure is used for mounting the motor, and the distance between the end surface of the raised structure facing away from the inner bottom surface and the inner top surface is the first distance A, where the ratio of the first distance A to the second distance B is greater than or equal to 0 and less than or equal to 35%.

In some examples, the drain auger further includes an extended guide tube and a feeding mechanism, where the feeding mechanism is connected to the front of the drum and is used for feeding or retracting the cable, and the extended guide tube is connected to the front end of the feeding mechanism and is used for guiding the cable.

In some examples, the extended guide tube is a straight tube structure; or the extended guide tube includes at least two straight tubes and a connecting elbow, where the connecting elbow is connected between two adjacent ones of the at least two straight tubes so that the two adjacent ones of the at least two straight tubes are connected at an included angle.

In some examples, the drain auger further includes a feeding mechanism, an operating member, and a stop structure, where the feeding mechanism is connected to the front of the drum and is used for feeding or retracting the cable, the operating member is connected to the feeding mechanism, a user operates the operating member to change a state in which the feeding mechanism clamps the cable, and the stop structure is driven by the operating member to move.

In some examples, the stop structure is a limiting elastic piece connected to the operating member, and the movement of the operating member is capable of driving the limiting elastic piece to be inserted into the cable so that the cable is not movable along the front and rear direction.

A drain auger includes a drum forming an accommodation space; a motor that drives the drum to rotate; a cable at least partially stored in the accommodation space; a handle connected to the rear of the drum and used for a user to hold; a feeding mechanism connected to the front of the drum and used for feeding or retracting the cable; and an operating member connected to the feeding mechanism and used for changing a state in which the feeding mechanism clamps the cable. The total length of the extended cable is defined as the cable length L, the drum has an inner bottom surface forming the accommodation space, the area of the inner bottom surface is S, and when the cable length L is measured in centimeters and the area S of the inner bottom surface is measured in square centimeters, the ratio L/S of the total length to the area of the inner bottom surface is greater than or equal to 4.4.

In some examples, the diameter of the inner bottom surface is the first diameter D, where the first diameter D is less than or equal to 14.5 cm.

In some examples, the maximum outer diameter of the drum is the second diameter D1, where the second diameter D1 is less than or equal to 17 cm.

In some examples, the cable placed in the accommodation space is in a coiled state, the maximum coiling height of the coiled cable is H, and when the cable length L of the cable is 762 cm, the maximum coiling height H is less than or equal to 7.5 cm.

A drain auger includes a drum forming an accommodation space; a motor that drives the drum to rotate; a cable at least partially stored in the accommodation space; a feeding mechanism connected to the front of the drum and used for feeding or retracting the cable; and a stop structure, where when the cable placed in the accommodation space is in a coiled state and reaches the maximum coiling height, the stop structure prevents the cable from popping out.

In some examples, the drain auger further includes an operating member connected to the feeding mechanism, where a user operates the operating member to change a state in which the feeding mechanism clamps the cable.

In some examples, the feeding mechanism includes rotary bodies around the cable, and a rotary body of the rotary bodies is driven by the operating member to move toward the cable or move away from the cable.

In some examples, the stop structure is driven by the operating member to move.

In some examples, the stop structure is connected to the operating member, or the stop structure is disposed on the operating member.

In some examples, the stop structure is a limiting elastic piece connected to the operating member, and the movement of the operating member is capable of driving the limiting elastic piece to be inserted into the cable so that the cable is not movable along the front and rear direction.

In some examples, an end of the limiting elastic piece is provided with a clamping portion capable of clamping the cable.

In some examples, a limiting protrusion is disposed on the cable, and the outer diameter of the limiting protrusion is greater than the maximum outer diameter of the cable allowed to pass through the rotary body.

In some examples, the stop structure is the rotary body, and the rotary body defines the position of the limiting protrusion so that the cable is not movable along the front and rear direction.

In some examples, the length of the cable beyond the front end surface of the feeding mechanism is the third length L3, where the third length L3 is less than or equal to 60 mm.

DETAILED DESCRIPTION

Figure 1:
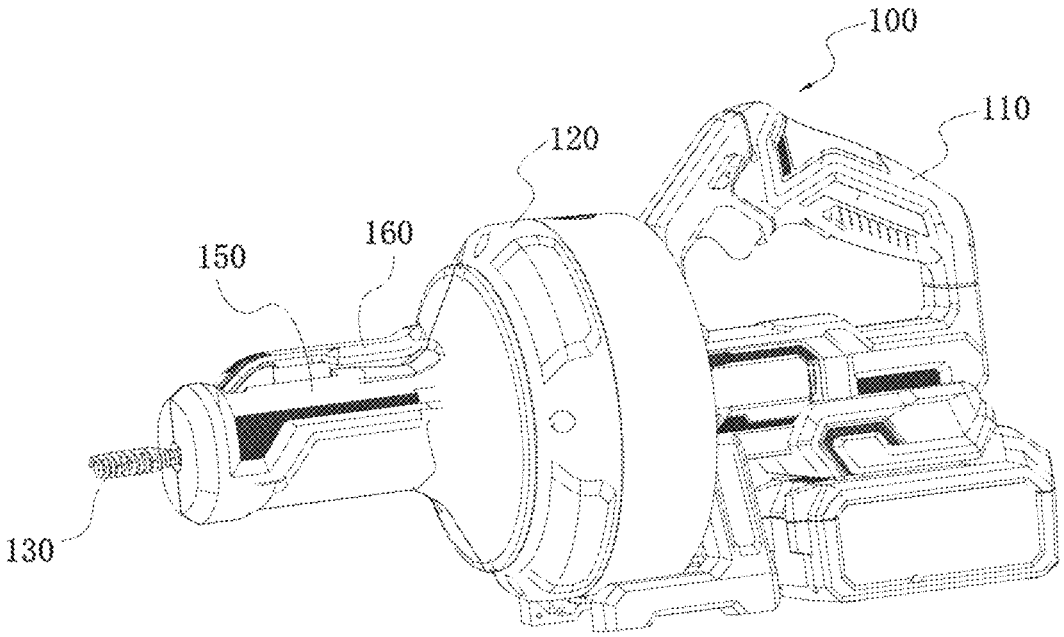
FIG. 1 is a schematic view of a drain auger according to an example of the present application.

Before any example of the present application is explained in detail, it is to be understood that the present application is not limited to its application to the structural details and the arrangement of components set forth in the following description or illustrated in the preceding drawings.

In the present application, the term "comprising", "including", "having", or any other variant thereof is intended to encompass a non-exclusive inclusion so that a process, method, article, or apparatus that includes a series of elements not only includes those elements but also includes other elements that are not expressly listed or further includes elements that are inherent to such a process, method, article, or apparatus. In the absence of more limitations, an element defined by the statement "including a . . . " does not exclude the presence of additional identical elements in a process, method, article, or apparatus including the element.

In the present application, the term "and/or" is an association relationship describing associated objects and indicates that three relationships may exist. For example, A and/or B may indicate that A exists alone, both A and B exist, and B exists alone. In addition, in the present application, the character "/" generally indicates an "and/or" relationship between associated objects before and after the character "/".

In the present application, the terms "connected", "combined", "coupled", and "mounted" may be directly connected, combined, coupled, or mounted and may also be indirectly connected, combined, coupled, or mounted. Among them, for example, direct connection means that two parts or assemblies are connected together without intermediate pieces, and indirect connection means that two parts or assemblies are separately connected to at least one intermediate piece and the two parts or assemblies are connected to each other by the at least one intermediate piece. In addition, "connection" and "coupling" are not limited to physical or mechanical connections or couplings and may include electrical connections or couplings.

In the present application, it is to be understood by those of ordinary skill in the art that a relative term (for example, "about", "approximately", or "basically") used in conjunction with quantities or conditions is inclusive of the stated value and has the meaning indicated by the context. For example, the relative term includes at least a degree of error associated with the measurement of a particular value, a tolerance caused by manufacturing, assembly, and use associated with the particular value, and the like. Such relative term should also be considered as disclosing the range defined by the absolute values of the two endpoints. The relative term may refer to plus or minus a certain percentage (such as 1%, 5%, 10%, or more) of an indicated value. A value not modified by the relative term should also be disclosed as a particular value with a tolerance. In addition, when expressing a relative angular position relationship (for example, basically parallel or basically perpendicular), "basically" may refer to plus or minus a certain degree (such as 1 degree, 5 degrees, 10 degrees, or more) based on an indicated angle.

In the present application, it is to be understood by those of ordinary skill in the art that the function implemented by an assembly may be implemented by one assembly, multiple assemblies, one part, or multiple parts. Similarly, a function implemented by a part may be implemented by one part, one assembly, or a combination of parts.

In the present application, the terms "upper", "lower", "left", "right", "front", "rear", and other orientation words are described by the orientations and position relations shown in the drawings and should not be understood as a limitation to the examples of the present application. In addition, in this context, it also needs to be understood that when it is mentioned that an element is connected "above" or "below" another element, the element not only can be directly connected "above" or "below" the other element but also can be indirectly connected "above" or "below" the other element through an intermediate element. Further, it should be understood that orientation words such as the upper side, lower side, left side, right side, front side, and rear side not only represent perfect orientations but also may be understood as lateral orientations. For example, the lower part may include directly below, lower left, lower right, lower front, and lower back.

As shown in FIGS. 1 to 5, the present application provides a drain auger 100. The drain auger 100 can clean the foreign matter in a pipe and restore the pipe to a smooth state. Specifically, the drain auger 100 includes a drum 120, a motor 140, and a cable 130. The drum 120 is the main component for accommodating the cable 130. An accommodation space 121 is formed in the drum 120, and the drum 120 has an inner bottom surface 123 and an inner top surface 124 that form the accommodation space 121. The inner bottom surface 123 and the inner top surface 124 are spaced and opposite to each other in the front and rear direction of the drain auger 100. The diameter of the inner bottom surface 123 is defined as the first diameter D. The motor 140 is connected to the rear of the drum 120 and can drive the drum 120 to rotate about an axis. The cable 130 is at least partially stored in the accommodation space 121, and the part of the cable 130 placed in the accommodation space 121 is generally in a coiled state. Driven by the motor 140, the drum 120 drivingly connected to the motor 140 rotates about the central axis. As the drum 120 rotates, the cable 130 can switch from the coiled state to an extended state or from the extended state to the coiled state. The total length of the extended cable 130 is defined as the cable length L.

In an example of the present application, the ratio of the total length to the square of the first diameter is greater than or equal to 3.5, that is, $L/D^2$ is greater than or equal to 3.5. It is to be noted that the cable length L and the first diameter D here are both measured in centimeters. When any one of the cable length L and the first diameter D is measured in units other than centimeters, the units must be converted into centimeters before calculation. The drain auger 100 limits the ratio of the cable length L of the extended cable 130 to the square of the first diameter D of the inner bottom surface 123 to a range greater than or equal to 3.5 so that the utilization rate of the accommodation space 121 inside the drum 120 is high, and the overall drain auger 100 is small and easy to hold and operate.

In a specific example, $L/D^2$ is 3.6. In a specific example, $L/D^2$ is 3.7. In a specific example, $L/D^2$ is 3.8. In a specific example, $L/D^2$ is 3.9. In a specific example, $L/D^2$ is 4.0. In a specific example, $L/D^2$ is 4.1. In a specific example, $L/D^2$ is 4.2.

In some examples, the first diameter D is less than or equal to 14.5 cm. In some specific examples, the first diameter D is less than or equal to 14 cm. In some other examples, the first diameter D is less than or equal to 13.5 cm.

In a specific example, the first diameter D is 14.5 cm. In a specific example, the first diameter D is 14 cm. In a specific example, the first diameter D is 13.7 cm. In a specific example, the first diameter D is 13 cm.

Figure 3:
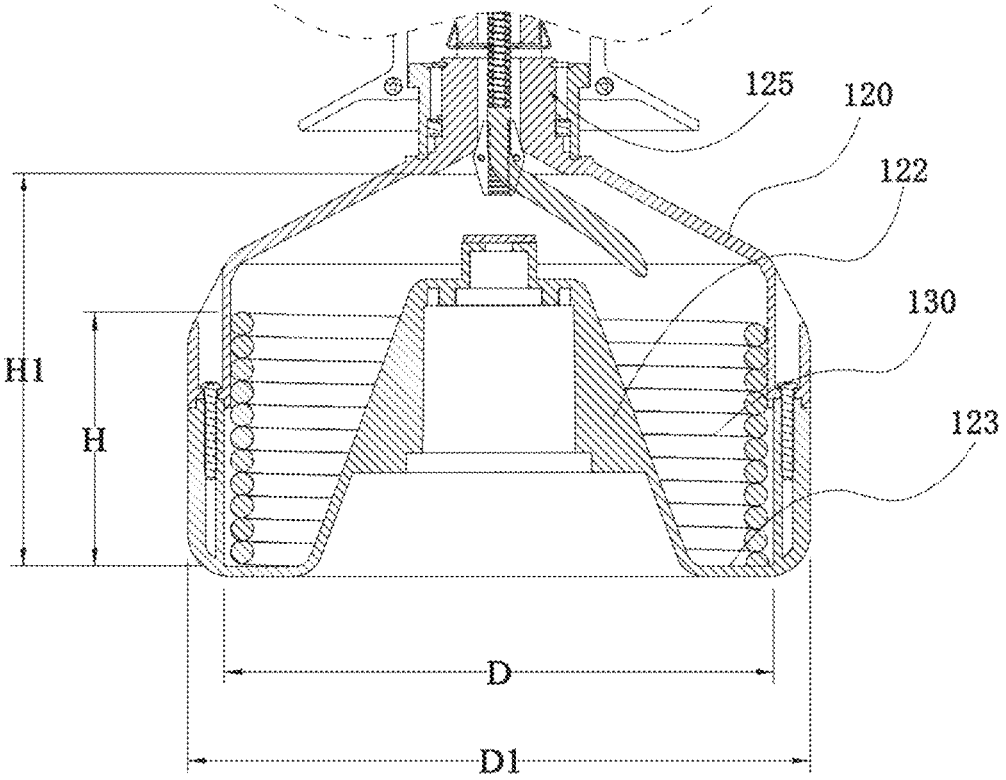
FIG. 3 is a sectional view of a drum of a drain auger according to an example of the present application.

As shown in FIG. 3, the maximum outer diameter of the drum 120 is defined as the second diameter D1. The second diameter D1 is greater than the first diameter D. The second diameter D1 is less than or equal to 17 cm. Further, in some examples, the second diameter D1 is less than or equal to 16.5 cm. Furthermore, in some examples, the second diameter D1 is less than or equal to 16 cm.

In a specific example, the second diameter D1 is 17 cm. In a specific example, the second diameter D1 is 16.5 cm. In a specific example, the second diameter D1 is 16 cm. In a specific example, the second diameter D1 is 15.5 cm.

With continued reference to FIG. 3, at least part of the cable 130 is in the coiled state and placed in the accommodation space 121. When the cable length L of the cable 130 is 762 cm, the maximum coiling height of the coiled cable 130 is H, and the maximum coiling height H is less than or equal to 7.5 cm. In some examples, when the cable length L of the cable 130 is 762 cm, the maximum coiling height H is less than or equal to 7 cm.

In a specific example, the maximum coiling height H is 6.7 cm. In a specific example, the maximum coiling height H is 6.5 cm. In a specific example, the maximum coiling height H is 6.3 cm. In a specific example, the maximum coiling height H is 6 cm. It is to be noted that the maximum coiling height H involved in the present application refers to the maximum coiling height of the cable 130 with a cable length L of 762 cm.

With continued reference to FIG. 3, the overall height of the accommodation space 121 is H1, that is, the distance from an end surface of the drum 120 at a contraction portion 125 to the inner bottom surface 123 of the drum 120 is the overall height H1 of the accommodation space 121. The contraction portion 125 is a portion where the drum 120 is of the smallest inner diameter. In some examples, the overall height H1 of the accommodation space 121 is greater than 7.5 cm. In some examples, the overall height H1 is about 8.5 cm. In some examples, the overall height H1 is about 9.5 cm. The overall height H1 refers to the height from the inner bottom surface 123 inside the drum 120 to the contraction portion of the drum 120 extending to an operating member 160.

The effective volume of the accommodation space 121 of the drum 120 is defined as V1, and $V1=\pi\times(D/2)^2\times H$, where H denotes the maximum coiling height of the cable 130 coiled in the accommodation space 121. It is to be noted that the effective volume here refers to the volume occupied by the cable 130 in the accommodation space 121. When the cable length L of the cable 130 is measured in centimeters and the effective volume V1 is measured in cubic centimeters, the ratio of the cable length L of the cable 130 to the effective volume V1 is greater than or equal to 0.75. Any following limitation on this ratio must satisfy the unit requirements set forth in this paragraph. In some examples, the ratio of the cable length L of the cable 130 to the effective volume V1 is greater than or equal to 0.8.

In a specific example, the ratio of the cable length L to the effective volume V1 is 0.8. In a specific example, the ratio of the cable length L to the effective volume V1 is 0.82. In a specific example, the ratio of the cable length L to the effective volume V1 is 0.84. In a specific example, the ratio of the cable length L to the effective volume V1 is 0.86. In a specific example, the ratio of the cable length L to the effective volume V1 is 0.88.

The area of the inner bottom surface 123 is defined as S. When the cable length L is measured in centimeters and the area S of the inner bottom surface 123 is measured in square centimeters, the ratio of the cable length L to the area of the inner bottom surface 123 is greater than or equal to 4.4, that is, the value of the ratio of the cable length L to the area of the inner bottom surface 123 is greater than or equal to 4.4. In an example, when the inner bottom surface 123 is basically circular, $S=\pi\times(D/2)^2$. Any following limitation on this ratio must satisfy the unit requirements set forth in this paragraph.

In some examples, the ratio of the total length of the extended cable 130 to the area of the inner bottom surface 123 is greater than or equal to 4.5. In some examples, the ratio of the total length of the extended cable 130 to the area of the inner bottom surface 123 is greater than or equal to 4.6. In some examples, the ratio of the total length of the extended cable 130 to the area of the inner bottom surface 123 is greater than or equal to 4.7. In some examples, the ratio of the total length of the extended cable 130 to the area of the inner bottom surface 123 is greater than or equal to 4.8. In some examples, the ratio of the total length of the extended cable 130 to the area of the inner bottom surface 123 is greater than or equal to 4.9. In some examples, the ratio of the total length of the extended cable 130 to the area of the inner bottom surface 123 is greater than or equal to 5.0. In some examples, the ratio of the total length of the extended cable 130 to the area of the inner bottom surface 123 is greater than or equal to 5.1. In some examples, the ratio of the total length of the extended cable 130 to the area of the inner bottom surface 123 is greater than or equal to 5.2. In some examples, the ratio of the total length of the extended cable 130 to the area of the inner bottom surface 123 is greater than or equal to 5.3. In some examples, the ratio of the total length of the extended cable 130 to the area of the inner bottom surface 123 is greater than or equal to 5.4. It is to be noted that the total length here is measured in centimeters, and the area of the inner bottom surface 123 is measured in square centimeters.

In a specific example, the ratio of the total length of the extended cable 130 to the area of the inner bottom surface 123 is 5.4. In a specific example, the ratio of the total length of the extended cable 130 to the area of the inner bottom surface 123 is 5.5. In a specific example, the ratio of the total length of the extended cable 130 to the area of the inner bottom surface 123 is 5.6.

The total volume of the accommodation space 121 of the drum 120 is V2, and the ratio of the effective volume V1 to the total volume V2 is greater than or equal to 80% and less than or equal to 100%. It is to be noted that the total volume V2 is the overall volume of the accommodation space 121, that is, the volume within a height range of H1.

In some examples, the ratio of the effective volume V1 to the total volume V2 is greater than or equal to 85% and less than or equal to 95%.

In a specific example, the ratio of the effective volume V1 to the total volume V2 is 86%. In a specific example, the ratio of the effective volume V1 to the total volume V2 is 88%. In a specific example, the ratio of the effective volume V1 to the total volume V2 is 89%. In a specific example, the ratio of the effective volume V1 to the total volume V2 is 91%. In a specific example, the ratio of the effective volume V1 to the total volume V2 is 93%.

In an example, the ratio of the cable length L to the square of the first diameter D is about 3.8, the first diameter D is 13.7 cm, the second diameter D1 is 16 cm, the maximum coiling height H is about 6.5 cm, the ratio of the cable length L to the effective volume V1 is about 0.8, and the ratio of the cable length L to the area of the inner bottom surface 123 is about 5.1. The various parameters described in this paragraph are based on the unit requirements described above, and the details are not repeated here.

With continued reference to FIG. 1, the drain auger 100 further includes a handle 110 and a feeding mechanism 150. The handle 110 is connected to the rear of the drum 120 and is used for a user to hold, and the feeding mechanism 150 is connected to the front of the drum 120 and is used for feeding or retracting the cable 130. The feeding mechanism 150 includes rotary bodies 152 around the cable 130. The rotary body 152 is driven to move toward the cable 130 or move away from the cable 130. The operating member 160 drives the rotary body 152 to move. The specific structure of the feeding mechanism 150 is the existing art, and the details are not repeated here. With continued reference to FIG. 2, the distance between a rear end surface of the handle 110 and a front end surface 153 of the feeding mechanism 150 is the overall length L0 of the drain auger 100, and the overall length L0 is less than or equal to 37 cm.

In a specific example, the overall length L0 is 36.5 cm. In a specific example, the overall length L0 is 36 cm. In a specific example, the overall length L0 is 35 cm.

With continued reference to FIG. 1, the drain auger 100 further includes the operating member 160 connected to the feeding mechanism 150 and used for changing a state in which the feeding mechanism 150 clamps the cable 130. In some examples, the operating member 160 is a grip, and by pressing the grip to move the rotary body 152 toward or away from the cable 130, the feeding mechanism 150 can clamp the cable 130 or be separated from the cable 130. The electric motor can drive the feeding mechanism 150 to continuously clamp the cable 130 and move the cable 130 toward the inside of the drum 120 so that the cable 130 is coiled in the drum 120.

Figure 8:
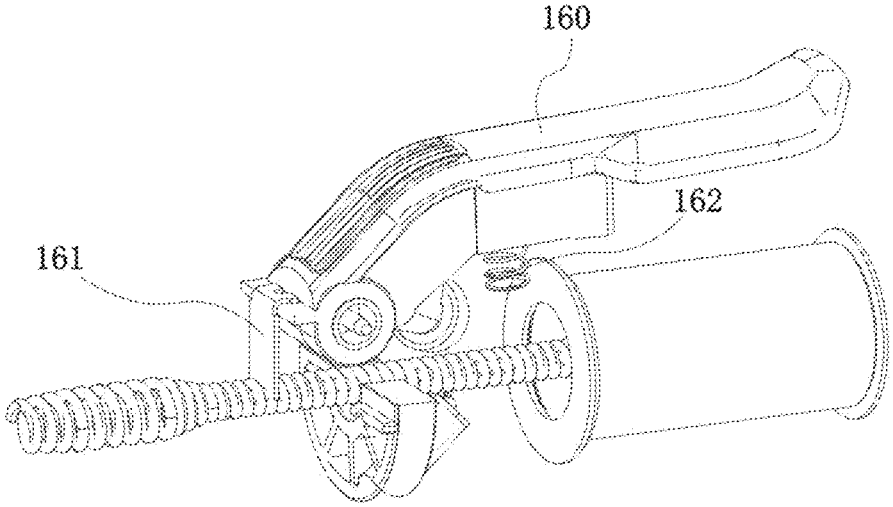
FIG. 8 is a schematic view of an operating member, a limiting elastic piece, and a cable of a drain auger according to an example of the present application.
Figure 9:
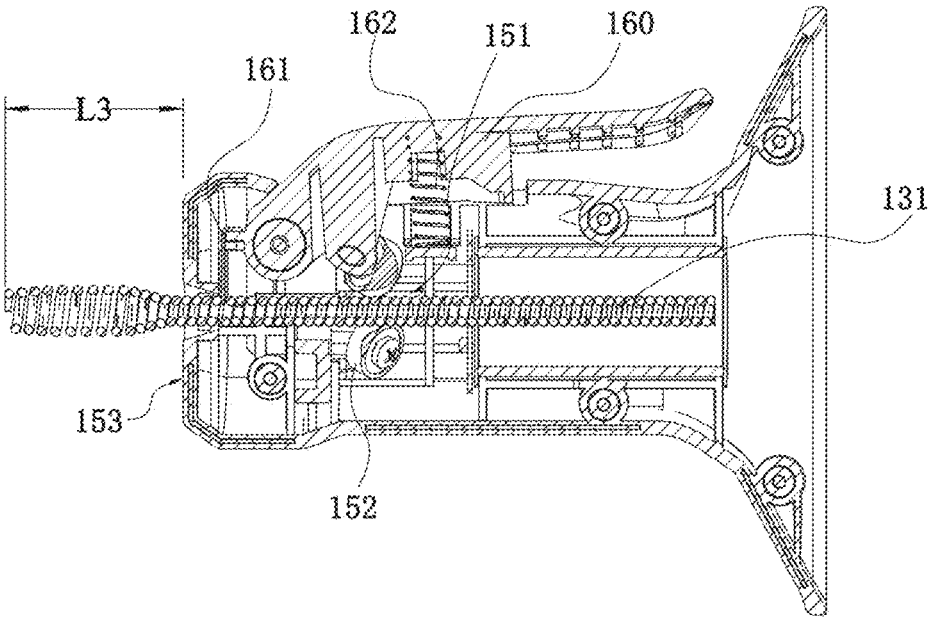
FIG. 9 is a sectional view of part of the structures of a drain auger according to an example of the present application.
Figure 10:
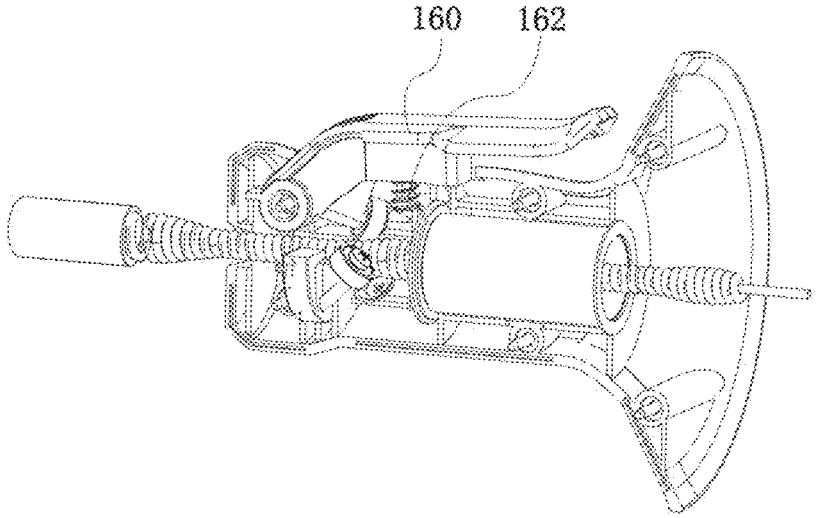
FIG. 10 is an internal schematic view of part of the structures of a drain auger according to an example of the present application.

As shown in FIGS. 8 to 10, a channel 151 for the cable 130 to pass through is formed in the feeding mechanism 150, and the radial dimension of the channel 151 is changeable by operating the operating member 160. In some examples, the operating member 160 includes a first end and a second end opposite to each other, the first end is rotatably connected to the feeding mechanism 150, the second end is a pressing end, and an elastic member 162 is disposed between the middle part of the operating member 160 and the feeding mechanism 150.

When the entire cable 130 is retracted into the accommodation space 121 of the drum 120, since the cable 130 is tightly coiled in the accommodation space 121, the cable 130 has a tendency to pop out of the front end surface 153. To overcome this tendency, the drain auger 100 provided in the present application further includes a stop structure. When the cable 130 placed in the accommodation space 121 is in the coiled state and reaches the maximum coiling height, the stop structure prevents the cable 130 from popping out. That is to say, the stop structure can provide a blocking force to overcome the pop-out force generated by the cable 130 in the compressed state.

It is to be noted that the reason why the cable 130 of the present application can be coiled more tightly in the accommodation space 121 is that when the rotary body 152 of the feeding mechanism 150 clamps the cable 130, the clamping force provided by the rotary body 152 is relatively large so that the retracted cable 130 can be tightly coiled, thereby reducing the length of the drum 120 in the front and rear direction and reducing the overall length of the drain auger 100.

In some examples, the stop structure is driven by the operating member 160 to move.

Further, the stop structure is a limiting elastic piece 161 connected to the operating member 160, and the movement of the operating member 160 is capable of driving the limiting elastic piece 161 to be inserted into the cable 130 so that the cable 130 is not movable along the front and rear direction.

In a specific example, an end of the limiting elastic piece 161 is fixedly connected to the first end of the operating member 160, and the other end of the limiting elastic piece 161 is provided with a clamping portion capable of clamping the cable 130. Optionally, the clamping portion is a limiting arc surface clamped on the outer wall surface of the cable 130 or a limiting tip that can be inserted into the cable 130.

The elastic member 162 and the limiting elastic piece 161 are provided so that the operating member 160 forms a seesaw structure. When the operating member 160 is in a free state without being pressed, the pressing end of the operating member 160 is lifted up by the elastic member 162 so that the limiting elastic piece 161 clamps the cable 130, and the cable 130 is placed in the clamping portion of the limiting elastic piece 161. After the pressing end of the operating member 160 is pressed down by an external force, that is, when the drain auger 100 needs to retract or release the cable 130, the limiting elastic piece 161 is lifted up and releases the clamping on the cable 130 so that the cable 130 can freely enter and exit the drain auger. When the user releases the operating member 160 after completing retracting or outputting the cable 130, under the elastic force of the elastic member 162, the limiting elastic piece 161 returns to the state of clamping the cable 130, thereby preventing the cable 130 from being accidentally detached. In addition, the limiting elastic piece 161 can prevent a small section of the front end of the cable 130 from popping out after the cable 130 is completely retracted, thereby improving the user experience.

Figure 11:
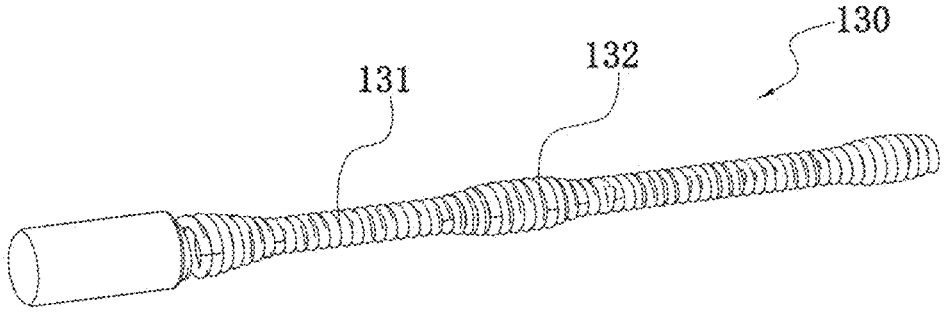
FIG. 11 is a schematic view of a cable of a drain auger according to an example of the present application.
Figure 12:
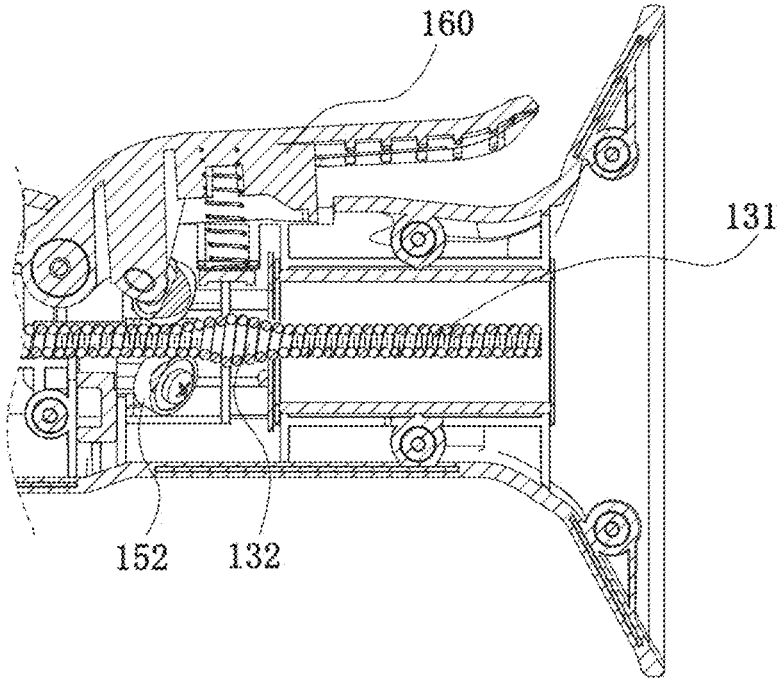
FIG. 12 is a sectional view of the cable in FIG. 11 used in the drain auger.

As shown in FIGS. 11 and 12, in some examples, the cable 130 includes a body portion 131 and a limiting protrusion 132, the radial dimension of the limiting protrusion 132 is greater than the radial dimension of the body portion 131, and when the operating member 160 is in an initial state, the radial dimension of the channel 151 is less than the radial dimension of the limiting protrusion 132. Specifically, the channel 151 is formed by multiple rotary bodies 152, and the outer diameter of the limiting protrusion 132 is greater than the maximum outer diameter of the cable allowed to pass through the rotary bodies 152.

In an example, the stop structure is the rotary body 152, and the rotary body 152 defines the position of the limiting protrusion 132 so that the cable 130 is not movable along the front and rear direction.

It is to be noted that when the operating member 160 is in the free state, the maximum outer diameter of the cable 130 allowed to pass through the channel 151 is 7 mm, and the outer diameter of the limiting protrusion 132 on the front part of the cable 130 is 7.2 mm to 7.5 mm. Although the outer diameter of the limiting protrusion 132 is greater than the maximum outer diameter of the cable 130 allowed to pass through the feeding mechanism 150, since the cable 130 is wound in circles, under the drive of the motor 140, a slight interference can allow the cable 130 to enter the feeding mechanism 150 through an opening. When the cable 130 is retracted, after the limiting protrusion 132 passes through the opening of the feeding mechanism 150, since the outer diameter of the limiting protrusion 132 is greater than the maximum outer diameter of the cable 130 allowed to pass through the opening of the feeding mechanism 150, it is ensured that if the cable 130 has a tendency to pop out, the cable 130 cannot pop out since the limiting protrusion 132 jams the feeding mechanism 150.

As shown in FIG. 9, when the cable 130 placed in the accommodation space 121 is in the coiled state and reaches the maximum coiling height, the length of the cable 130 beyond the front end surface 153 of the feeding mechanism 150 is the third length L3, where the third length L3 is less than or equal to 60 mm. In some specific examples, the third length L3 is less than or equal to 50 mm. In some specific examples, the third length L3 is less than or equal to 40 mm. In an example, the third length L3 is about 35 mm.

Figure 2:
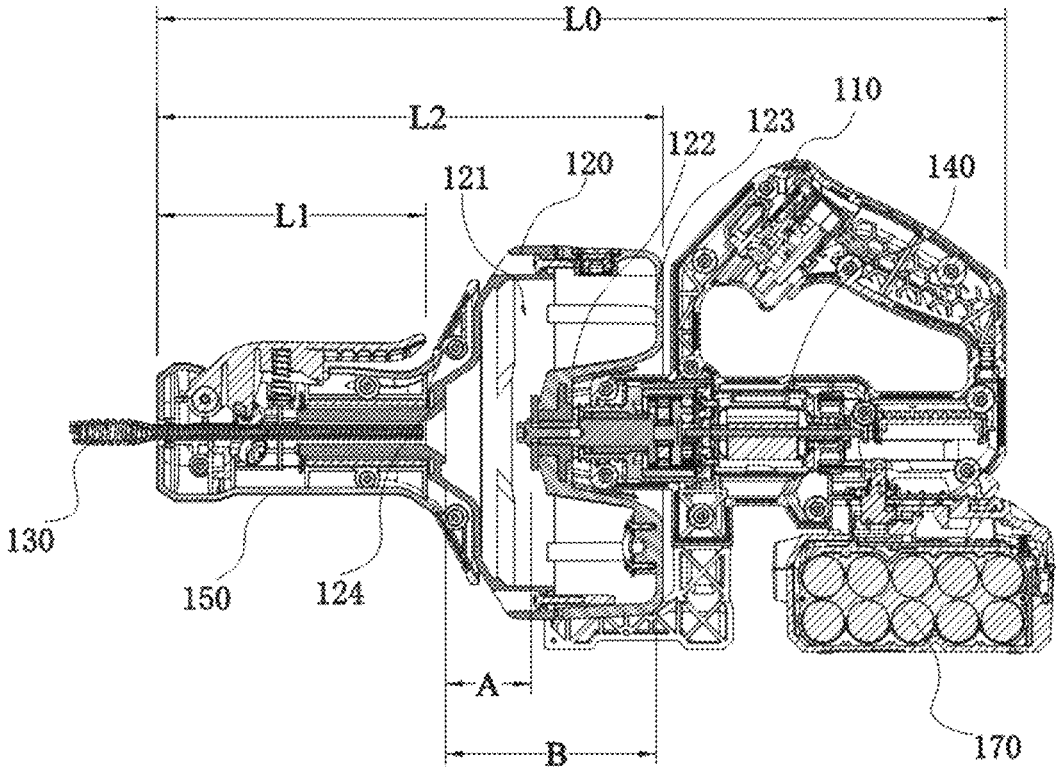
FIG. 2 is a sectional view of a drain auger according to an example of the present application.

With continued reference to FIG. 2, the distance between the front end surface 153 of the feeding mechanism 150 and the rear end surface of the operating member 160 is the first length L1, where the first length L1 is less than or equal to 12 cm.

In a specific example, the first length L1 is 12 cm. In a specific example, the first length L1 is 11.5 cm. In a specific example, the first length L1 is 11 cm. In a specific example, the first length L1 is 10.5 cm.

With continued reference to FIG. 2, the distance between the front end surface 153 of the feeding mechanism 150 and the rear end surface of the drum 120 is the second length L2, where the second length L2 is less than or equal to 23 cm.

In a specific example, the second length L2 is 22 cm. In a specific example, the second length L2 is 21.5 cm. In a specific example, the second length L2 is 21 cm. In a specific example, the second length L2 is 20.5 cm.

Figure 4:
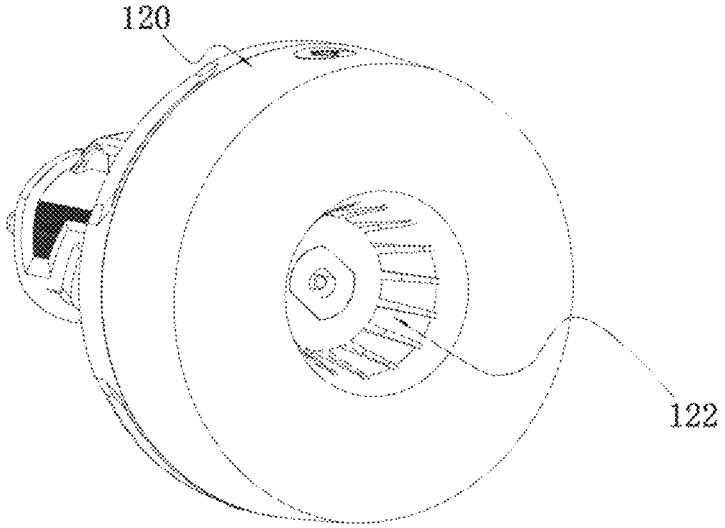
FIG. 4 is a schematic view of a drum and a feeding mechanism of a drain auger according to an example of the present application from a certain perspective.
Figure 5:
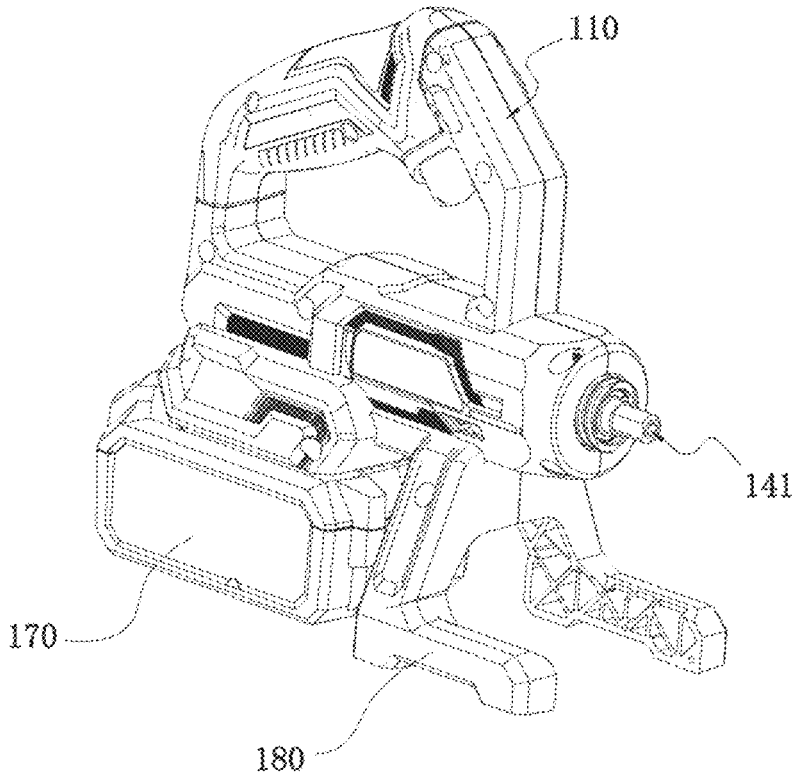
FIG. 5 is a schematic view of a handle, a battery pack, and a support member of a drain auger according to an example of the present application from a certain perspective.

With continued reference to FIGS. 2, 4, and 5, the distance between the inner bottom surface 123 and the inner top surface 124 of the accommodation space 121 is the second distance B, the drum 120 further includes a raised structure 122 protruding from the inner bottom surface 123 and extending toward the inner top surface 124, the raised structure 122 is used for mounting the motor 140, a motor shaft 141 of the motor 140 is fixedly connected to the top of the raised structure 122, and the distance between the end surface of the raised structure 122 facing away from the inner bottom surface 123 and the inner top surface 124 is the first distance A, where the ratio of the first distance A to the second distance B is greater than or equal to 0 and less than or equal to 35%. When the ratio of A to B is smaller, it indicates that more structures of the motor 140 can penetrate the drum 120. At this time, the length of the entire drain auger 100 can be significantly shortened, thereby making the drain auger 100 more compact.

In some examples, the ratio of the first distance A to the second distance B is about 28%.

It is to be noted that the ranges of the ratios disclosed in the present application refer to the numerical ranges of the ratios obtained in specific units.

When the drain auger 100 is used for unclogging a toilet, to guide the cable 130, the drain auger 100 further includes an extended guide tube 190 connected to the front end of the feeding mechanism 150 and used for guiding the cable 130. The extended guide tube 190 is used so that the distance between the outlet of the drain auger 100 and the pipe to be unclogged can be shortened, thereby avoiding the following case: the cable 130 is entangled due to a large distance, causing the unclogging to fail. In addition, the drain auger 100 is provided with the extended guide tube 190 so that it can be ensured that the outer surface of the drain auger 100 and the hands of the user operating the machine do not come into contact with the toilet sewage. Of course, the use scenario of the drain auger 100 provided with the extended guide tube 190 is not limited to unclogging the toilet and may be extended to the working condition where the distance from the front end of the drain auger 100 to the pipe to be unclogged is greater than or equal to 15 cm.

Figure 6:
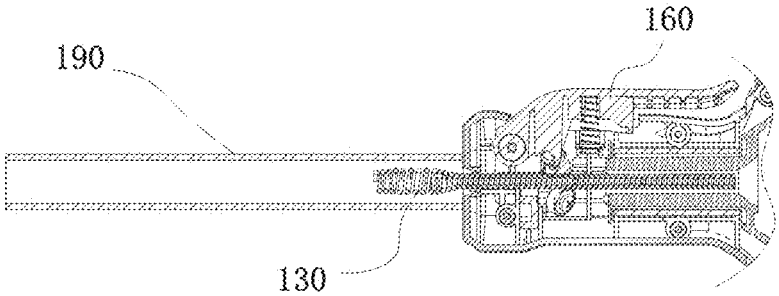
FIG. 6 is a first schematic view of a drain auger provided with an extended guide tube according to an example of the present application.

In some examples, as shown in FIG. 6, the extended guide tube 190 has a structure of a straight tube 191. The extended guide tube 190 with a structure of the straight tube 191 has a simple structure and a relatively low cost.

Figure 7:
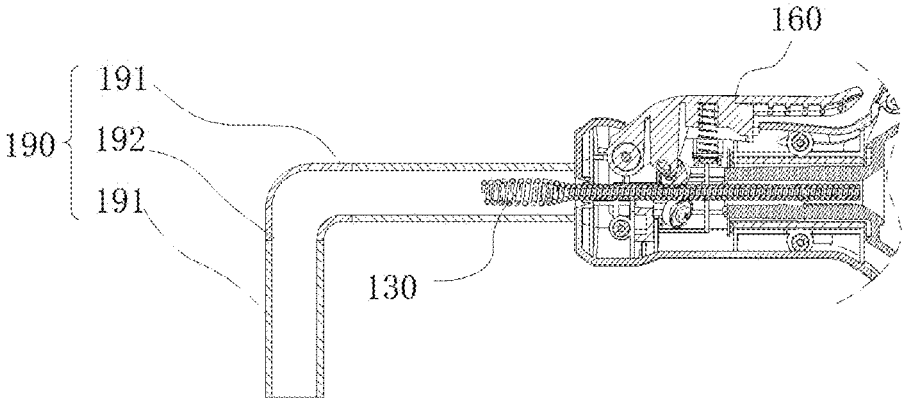
FIG. 7 is a second schematic view of a drain auger provided with an extended guide tube according to an example of the present application.

In some parallel examples, the extended guide tube 190 includes at least two straight tubes 191 and a connecting elbow 192, where the connecting elbow 192 is connected between two adjacent straight tubes 191 so that the two adjacent straight tubes 191 are connected at an included angle. In a specific example, as shown in FIG. 7, the extended guide tube 190 is basically "L"-shaped and includes two straight tubes 191 and the connecting elbow 192 connected between the two straight tubes and having a 90° corner. The extended guide pipe 190 with a non-straight-tube structure can cope with more severe working conditions.

In some examples, the extended guide tube 190 is detachably connected to the front end of the feeding mechanism 150, and the detachable connection manner includes, but is not limited to, a threaded connection, a snap-fit manner, or a magnetic attraction connection.

In some examples, the extended guide tube 190 is rotatably connected to the front end of the feeding mechanism 150 so that the extended guide tube 190 is rotatable between 0° to 90° to cope with more complex working environments.

With continued reference to FIG. 1, the drain auger 100 further includes a battery pack 170 detachably connected to the bottom of the handle 110. The detachable connection manner is not limited to slidable plugging. The battery pack 170 is connected to the motor 140 and is used for supplying power to the motor 140.

With continued reference to FIG. 5, the drain auger 100 further includes a support member 180 located on the lower part of the drain auger 100. When the user holds the drain auger 100, the support member 180 can be supported on a support surface provided by an external device or can be placed directly on the ground, thereby reducing the gravity of the drain auger 100 borne by the user. In some examples, the support member 180 is a support bracket formed by multiple rods.

The basic principles, main features, and advantages of the present application are shown and described above. It is to be understood by those skilled in the art that the preceding examples do not limit the present application in any form, and all technical solutions obtained through equivalent substitutions or equivalent transformations fall within the scope of the present application.

What is claimed is:

1. A drain auger, comprising:

a drum forming an accommodation space;

a motor that drives the drum to rotate; and a cable at least partially stored in the accommodation space;

wherein a total length of the extended cable has a cable length L, the drum has an inner bottom surface forming the accommodation space, a diameter of the inner bottom surface is a first diameter D, and when the cable length L and the first diameter D are both measured in centimeters, a ratio $L/D^2$ of the cable length L to a square of the first diameter D is greater than or equal to 3.5.

2. The drain auger of claim 1, wherein the first diameter D is less than or equal to 14.5 cm.

3. The drain auger of claim 1, wherein a maximum outer diameter of the drum is a second diameter D1 and the second diameter D1 is less than or equal to 17 cm.

4. The drain auger of claim 1, wherein the cable placed in the accommodation space is in a coiled state, a maximum coiling height of the coiled cable is H, and, when the cable length L of the cable is 762 cm, the maximum coiling height H is less than or equal to 7.5 cm.

5. The drain auger of claim 1, further comprising a handle and a feeding mechanism, wherein the handle is connected to a rear of the drum and is used for a user to hold, the feeding mechanism is connected to a front of the drum and is used for feeding or retracting the cable, a distance between a rear end surface of the handle and a front end surface of the feeding mechanism is an overall length L0 of the drain auger, and the overall length L0 is less than or equal to 37 cm.

6. The drain auger of claim 5, further comprising an operating member, wherein the operating member is connected to the feeding mechanism and is used for changing a state in which the feeding mechanism clamps the cable, a distance between the front end surface of the feeding mechanism and a rear end surface of the operating member is a first length L1, and the first length L1 is less than or equal to 12 cm.

7. The drain auger of claim 5, wherein a distance between the front end surface of the feeding mechanism and a rear end surface of the drum is a second length L2, and the second length L2 is less than or equal to 23 cm.

8. The drain auger of claim 6, wherein the operating member comprises a first end and a second end opposite to each other, the first end is rotatably connected to the feeding mechanism, the second end is a pressing end, an elastic member is disposed between a middle part of the operating member and the feeding mechanism, the drain auger further comprises a limiting elastic piece, an end of the limiting elastic piece is fixedly connected to the first end, and another end of the limiting elastic piece is provided with a clamping portion capable of clamping the cable.

9. The drain auger of claim 6, wherein a channel for the cable to pass through is formed in the feeding mechanism, a radial dimension of the channel is changeable by operating the operating member, the cable comprises a body portion and a limiting protrusion, a radial dimension of the limiting protrusion is greater than a radial dimension of the body portion, and, when the operating member is in an initial state, the radial dimension of the channel is less than the radial dimension of the limiting protrusion.

10. The drain auger of claim 1, wherein an effective volume of the accommodation space of the drum is defined as V1, $V1=\pi\times(D/2)^2\times H$, H denotes a maximum coiling height of the cable coiled in the accommodation space, and, when the cable length L is measured in centimeters and the effective volume V1 is measured in cubic centimeters, a ratio of the cable length L to the effective volume V1 is greater than or equal to 0.75.

11. The drain auger of claim 10, wherein a total volume of the accommodation space of the drum is V2, and a ratio of the effective volume V1 to the total volume V2 is greater than or equal to 80% and less than or equal to 100%.

12. The drain auger of claim 1, wherein the accommodation space comprises the inner bottom surface and an inner top surface, a distance between the inner bottom surface and the inner top surface is a second distance B, the drum further comprises a raised structure protruding from the inner bottom surface and extending toward the inner top surface, the raised structure is used for mounting the motor, a distance between an end surface of the raised structure facing away from the inner bottom surface and the inner top surface is a first distance A, and a ratio of the first distance A to the second distance B is greater than or equal to 0 and less than or equal to 35%.

13. The drain auger of claim 1, further comprising an extended guide tube and a feeding mechanism, wherein the feeding mechanism is connected to a front of the drum and is used for feeding or retracting the cable, and the extended guide tube is connected to a front end of the feeding mechanism and is used for guiding the cable.

14. The drain auger of claim 13, wherein the extended guide tube is a straight tube structure or comprises at least two straight tubes and a connecting elbow connected between two adjacent ones of the at least two straight tubes so that the two adjacent ones of the at least two straight tubes are connected at an included angle.

15. The drain auger of claim 1, further comprising a feeding mechanism, an operating member, and a stop structure, wherein the feeding mechanism is connected to a front of the drum and is used for feeding or retracting the cable, the operating member is connected to the feeding mechanism, a user operates the operating member to change a state in which the feeding mechanism clamps the cable, and the stop structure is driven by the operating member to move.

16. The drain auger of claim 15, wherein the stop structure is a limiting elastic piece connected to the operating member, and movement of the operating member is capable of driving the limiting elastic piece to be inserted into the cable so that the cable is not movable along a front and rear direction.

17. A drain auger, comprising:

a drum forming an accommodation space;

a motor that drives the drum to rotate;

a cable at least partially stored in the accommodation space;

a handle connected to the drum and used for a user to hold;

a feeding mechanism connected to a front of the drum and used for feeding or retracting the cable; and an operating member connected to the feeding mechanism and used for changing a state in which the feeding mechanism clamps the cable;

wherein a total length of the extended cable has a cable length L, the drum has an inner bottom surface forming the accommodation space, an area of the inner bottom surface is S, and, when the cable length L is measured in centimeters and the area S of the inner bottom surface is measured in square centimeters, a ratio L/S of the total length to the area of the inner bottom surface is greater than or equal to 4.4.

18. The drain auger of claim 17, wherein a diameter of the inner bottom surface is a first diameter D and the first diameter D is less than or equal to 14.5 cm.

19. The drain auger of claim 17, wherein a maximum outer diameter of the drum is a second diameter D1 and the second diameter D1 is less than or equal to 17 cm.

20. The drain auger of claim 17, wherein the cable placed in the accommodation space is in a coiled state, a maximum coiling height of the coiled cable is H, and, when the cable length L of the cable is 762 cm, the maximum coiling height H is less than or equal to 7.5 cm.

* * * * *